US009073672B2

(12) United States Patent
Laperriere et al.

(10) Patent No.: US 9,073,672 B2
(45) Date of Patent: Jul. 7, 2015

(54) STORAGE CONTAINER FOR ELECTRICAL COMPONENTS

(71) Applicant: Hubbell Incorporated, Shelton, CT (US)

(72) Inventors: Sarah Laperriere, Hampstead, NH (US); Michael Rzasa, Nashua, NH (US); Armand Montminy, Hooksett, NH (US); Rodd Ruland, Amherst, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 39 days.

(21) Appl. No.: 13/655,701

(22) Filed: Oct. 19, 2012

(65) Prior Publication Data

US 2013/0068716 A1 Mar. 21, 2013

Related U.S. Application Data

(63) Continuation-in-part of application No. 13/117,342, filed on May 27, 2011.

(51) Int. Cl.

| | |
|---|---|
| ***B65D 41/02*** | (2006.01) |
| ***B65D 41/06*** | (2006.01) |
| ***B67B 3/20*** | (2006.01) |
| ***B65D 41/56*** | (2006.01) |
| ***B65D 51/24*** | (2006.01) |

(52) U.S. Cl.

CPC . *B65D 41/02* (2013.01); *B67B 3/20* (2013.01); *B65D 41/06* (2013.01); *B65D 41/56* (2013.01); *B65D 51/242* (2013.01)

(58) Field of Classification Search

CPC ..... B65D 41/02; B65D 51/242; B65D 41/06; B65D 41/56; B67B 3/20

USPC ..... 220/379, 744, 293, 752; 215/201, 230, 215/203, 217, 219, 220, 901

See application file for complete search history.

(56) References Cited

U.S. PATENT DOCUMENTS

| | | | |
|---|---|---|---|
| 1,184,881 | A | 5/1916 | Schumacher |
| 1,911,354 | A | 5/1933 | De Long |
| 2,069,048 | A | 1/1937 | Rehberger |
| 2,429,958 | A | 10/1947 | Liebmann |
| 3,017,049 | A | 1/1962 | Powell |
| 3,090,067 | A | 5/1963 | Weiby |
| 3,741,421 | A | 6/1973 | Wittwer |
| 3,854,582 | A | 12/1974 | Martinelli |
| D243,975 | S | 4/1977 | Persson |
| D255,218 | S | 6/1980 | Krag |
| 4,375,859 | A | 3/1983 | Fillmore |
| 4,387,822 | A | 6/1983 | Lynn |
| D276,285 | S | 11/1984 | Tober |

(Continued)

*Primary Examiner* — Robert J Hicks
*Assistant Examiner* — Kareen Rush
(74) *Attorney, Agent, or Firm* — Roylance, Abrams, Berdo & Goodman, L.L.P.

(57) ABSTRACT

A storage container includes a jar and a cap removably connected to the jar. The jar has a cavity defined by a first base and a first wall extending upwardly from the first base. A first alignment indicator is disposed on an outer surface of the first wall. A cap is removably connectable to the jar. The cap has an upper portion connected to a lower portion by a connecting member. The lower portion has a second base and a second wall extending downwardly therefrom. A second alignment indicator is disposed on an outer surface of the second wall of the lower portion. The first and second alignment indicators are aligned to substantially prevent misalignment of the cap with respect to the jar when connecting the cap to the jar.

19 Claims, 15 Drawing Sheets

(56) References Cited

U.S. PATENT DOCUMENTS

| | | | | |
|---|---|---|---|---|
| 4,588,098 | A * | 5/1986 | Uzdy | 215/230 |
| 4,992,910 | A | 2/1991 | Evans | |
| 5,035,324 | A | 7/1991 | Bertrand | |
| D332,967 | S | 2/1993 | Oglesby | |
| D351,728 | S | 10/1994 | Drever | |
| 5,358,129 | A | 10/1994 | Watts | |
| D357,584 | S | 4/1995 | Swingler | |
| 5,464,110 | A | 11/1995 | Heyworth | |
| 5,749,486 | A | 5/1998 | Porter | |
| 6,015,061 | A | 1/2000 | Lowry | |
| 6,145,685 | A | 11/2000 | Dick | |
| 6,209,737 | B1 * | 4/2001 | Bliss | 215/228 |
| D476,568 | S | 7/2003 | Mechtold | |
| 6,662,941 | B2 * | 12/2003 | Lowry et al. | 206/204 |
| D499,552 | S | 12/2004 | Nissanoff | |
| D535,476 | S | 1/2007 | Pennington | |
| D554,865 | S | 11/2007 | Roesler | |
| D558,451 | S | 1/2008 | Roesler | |
| D558,978 | S | 1/2008 | Roesler | |
| 7,318,574 | B2 | 1/2008 | Lee | |
| 7,665,611 | B2 * | 2/2010 | Koch | 206/534 |
| 7,845,505 | B2 | 12/2010 | Hamamoto | |
| D643,694 | S | 8/2011 | Lu | |
| 8,113,366 | B2 | 2/2012 | House | |
| 8,534,220 | B1 * | 9/2013 | Olson | 116/309 |
| 2010/0102020 | A1 * | 4/2010 | Sebille et al. | 215/44 |

* cited by examiner

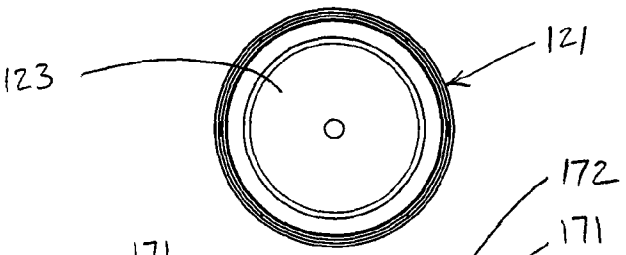
FIG. 29
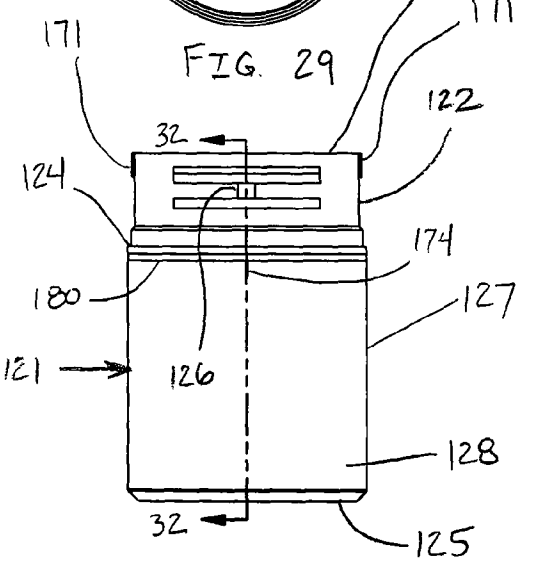
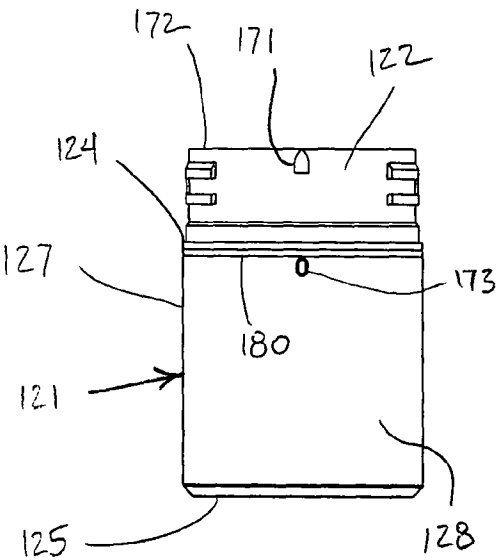
FIG. 30
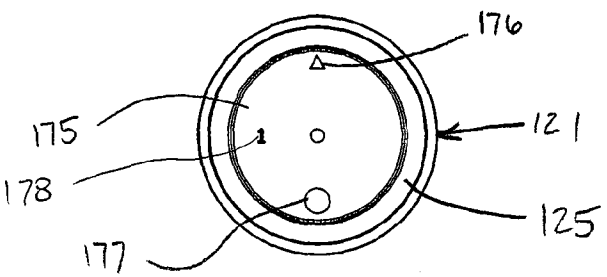
FIG. 31
FIG. 33
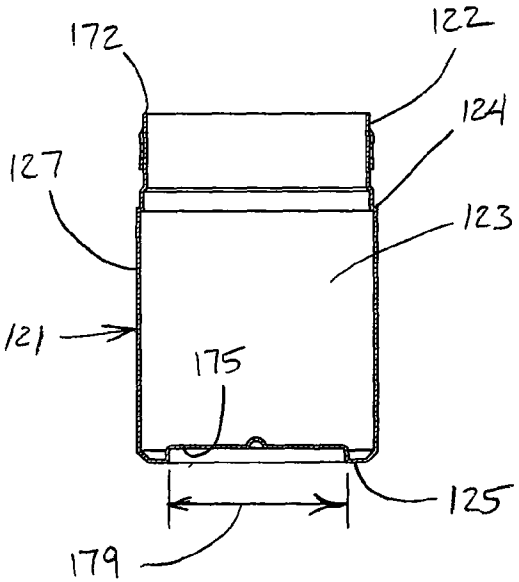
FIG. 32

STORAGE CONTAINER FOR ELECTRICAL COMPONENTS

CROSS-REFERENCE TO RELATED APPLICATION

This application is a continuation-in-part of U.S. patent application Ser. No. 13/117,342, filed May 27, 2011, which is hereby incorporated by reference in its entirety.

FIELD OF THE INVENTION

The present invention relates to a storage container for conveniently storing and accessing components stored therein. More particularly, the present invention relates to a storage container having a cap removably connected to a jar in which the cap has an opening for hanging the storage container. Still more particularly, the present invention relates to a storage container in which misalignment between a cap and a jar of the storage container is substantially prevented.

BACKGROUND OF THE INVENTION

Electric power transmission is the bulk transfer of electrical energy from generating power plants to substations located near population centers. Electricity distribution transmission is the wiring between the high voltage substations and customers. Electricians maintain electric power transmission and distribution facilities, and associated infrastructure related to distributing electricity to the customers.

The electrician often works in environments in which access to electrical components, such as electrical connectors, required for the job is restricted and difficult. Accordingly, a need exists for a storage container that conveniently stores and provides access to the electrical components stored therein.

Another problem encountered by an electrician is handling the electrical component prior to its use. The electrician generally holds the electrical component in his hand or mouth. Thus, the component can be easily dropped or lost. Additionally, by holding the electrical component in his hand, the electrician loses the ability to use that hand in performing the task.

Still another problem encountered by the electrician is misalignment between a cap and a jar of the storage container during installation. Accordingly, a need exists for a storage container in which misalignment between the jar and cap of the storage container is substantially prevented.

Accordingly, a need exists for a storage container that conveniently stores a component for quick and easy access.

SUMMARY OF THE INVENTION

Accordingly, it is a primary objective of the present invention to provide a storage container for electrical components.

A further objective of the present invention is to provide a storage container that provides quick and easy access to electrical components stored therein.

Another objective of the present invention is to provide a cap of a storage container that receives electrical components stored in the storage container.

Another objective of the present invention is to provide a cap of a storage container with an opening for connecting or mounting the storage container to a support.

Still another objective of the present invention is to provide a storage container in which misalignment of a cap with respect to a jar of the storage container is substantially prevented during installation.

The foregoing objectives are basically attained by a storage container having a jar and a cap removably connected to the jar. The jar has a cavity defined by a first base and a first wall extending upwardly from the first base. The cap has an upper portion connected to a lower portion by a connecting member. The upper portion has a second base and a second wall extending upwardly from the second base to define a receiving area to receive an item stored in the jar. The connecting member has an opening therethrough.

The foregoing objectives are also basically attained by a storage container for electrical components. A jar has a cavity to store the electrical components. A cap has an upper portion connected to a lower portion by a connecting member. The lower portion is removably connected to the jar and the upper portion is not connectable to the jar. The upper portion has a first receiving area and the lower portion has a second receiving area to receive the electrical components. An opening extends through the connecting member to receive a support.

The foregoing objectives are also basically attained by a method of temporarily storing electrical components stored in a storage container. A cap is removed from a jar of the storage container. The cap has an upper portion and a lower portion. The cap is positioned such that either the upper or lower portion is positioned on a support surface. At least one electrical component is removed from the jar and stored in the upper or lower portion of the cap not positioned on the support surface.

The foregoing objectives are also basically attained by a storage container having a cap removably connectable to a jar. The jar has a cavity defined by a first base and a first wall extending upwardly from the first base. A first alignment indicator is disposed on an outer surface of the first wall. A cap is removably connectable to the jar. The cap has an upper portion connected to a lower portion by a connecting member. The lower portion has a second base and a second wall extending downwardly therefrom. A second alignment indicator is disposed on an outer surface of the second wall of the lower portion. The first and second alignment indicators are aligned to substantially prevent misalignment of the cap with respect to the jar when connecting the cap to the jar.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the high-voltage test terminal, and are not intended to limit the structure of the high voltage test terminal to any particular position or orientation.

BRIEF DESCRIPTION OF THE DRAWINGS

The above aspects and features of the present invention will be more apparent from the description for an exemplary embodiment of the present invention taken with reference to the accompanying drawings, in which:

FIG. 29 is a top plan view of a jar of the storage container of FIG. 21;

FIG. 30 is a front elevational view of the jar of FIG. 21;

FIG. 31 is a side elevational view of the jar of FIG. 21;

FIG. 32 is a front elevational view in cross-section taken along line 32-32 of the jar of FIG. 21; and FIG. 33 is a bottom plan view of the jar of FIG. 21.

Throughout the drawings, like reference numerals will be understood to refer to like parts, components and structures.

DETAILED DESCRIPTION OF EXEMPLARY EMBODIMENTS

Figure 1:
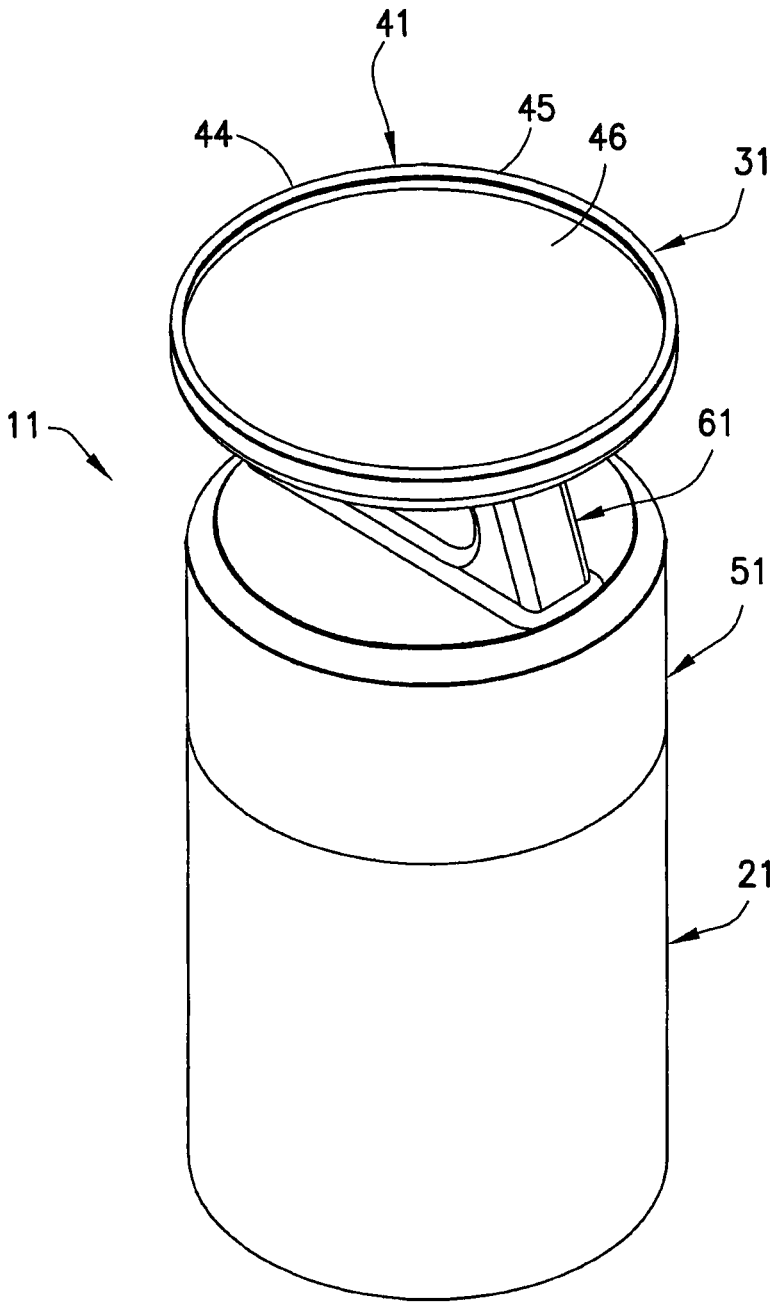
FIG. 1 is a perspective view of a storage container in accordance with a first exemplary embodiment of the present invention.

As shown in FIGS. 1-20, a storage container 11 has a jar 21 and a cap 31 removably connected to the jar. The jar 21 has a cavity 23 defined by a first base 25 and a first wall 27 extending upwardly from the first base 25. The cap 31 has an upper portion 41 connected to a lower portion 51 by a connecting member 61. The upper portion 41 has a second base 43 and a second wall 45 extending upwardly from the second base 43 to define a receiving area 48 that receives an item stored in the cavity 23 of the jar 21. The connecting member 61 has an opening 63 therethrough. Accordingly, the storage container 11 conveniently stores electrical components 13 therein and provides quick and easy access thereto.

Figure 14:
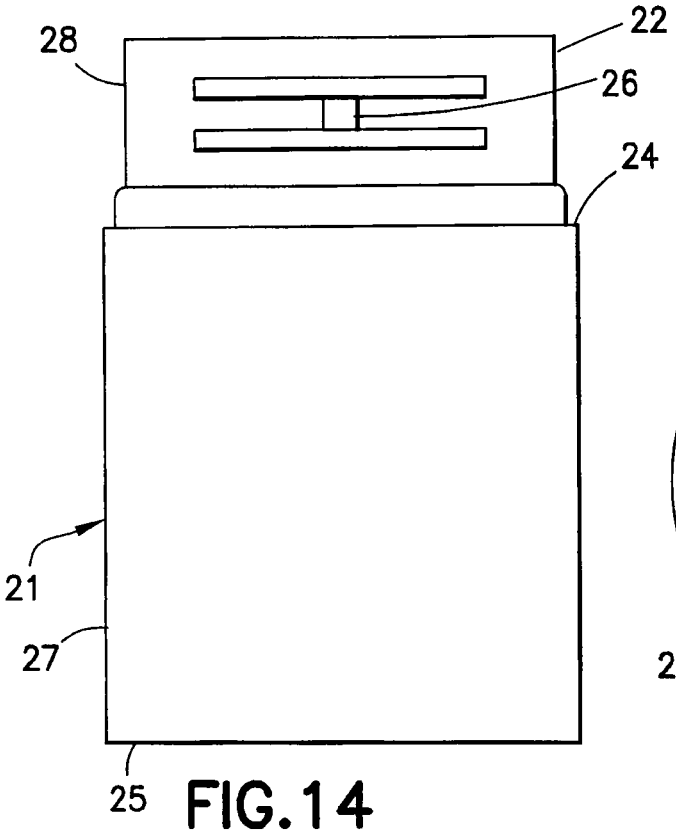
FIG. 14 is a side elevational view of the jar of FIG. 12.
Figure 16:
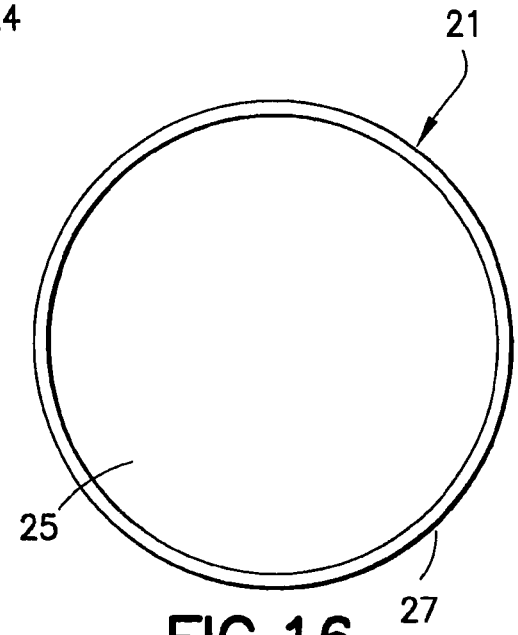
FIG. 16 is a bottom plan view of the jar of FIG. 7.
Figure 15:
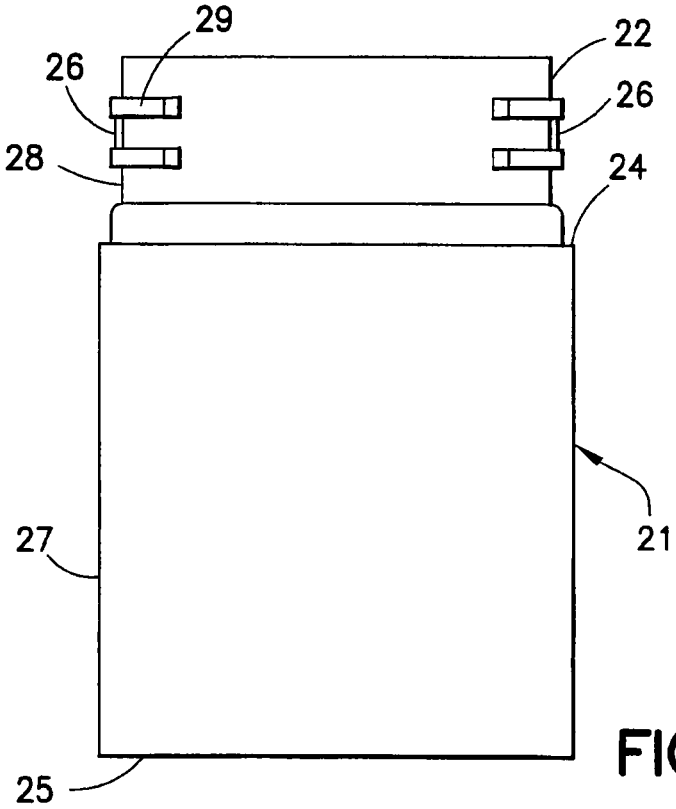
FIG. 15 is a front elevational view of the jar of FIG. 12.
Figure 18:
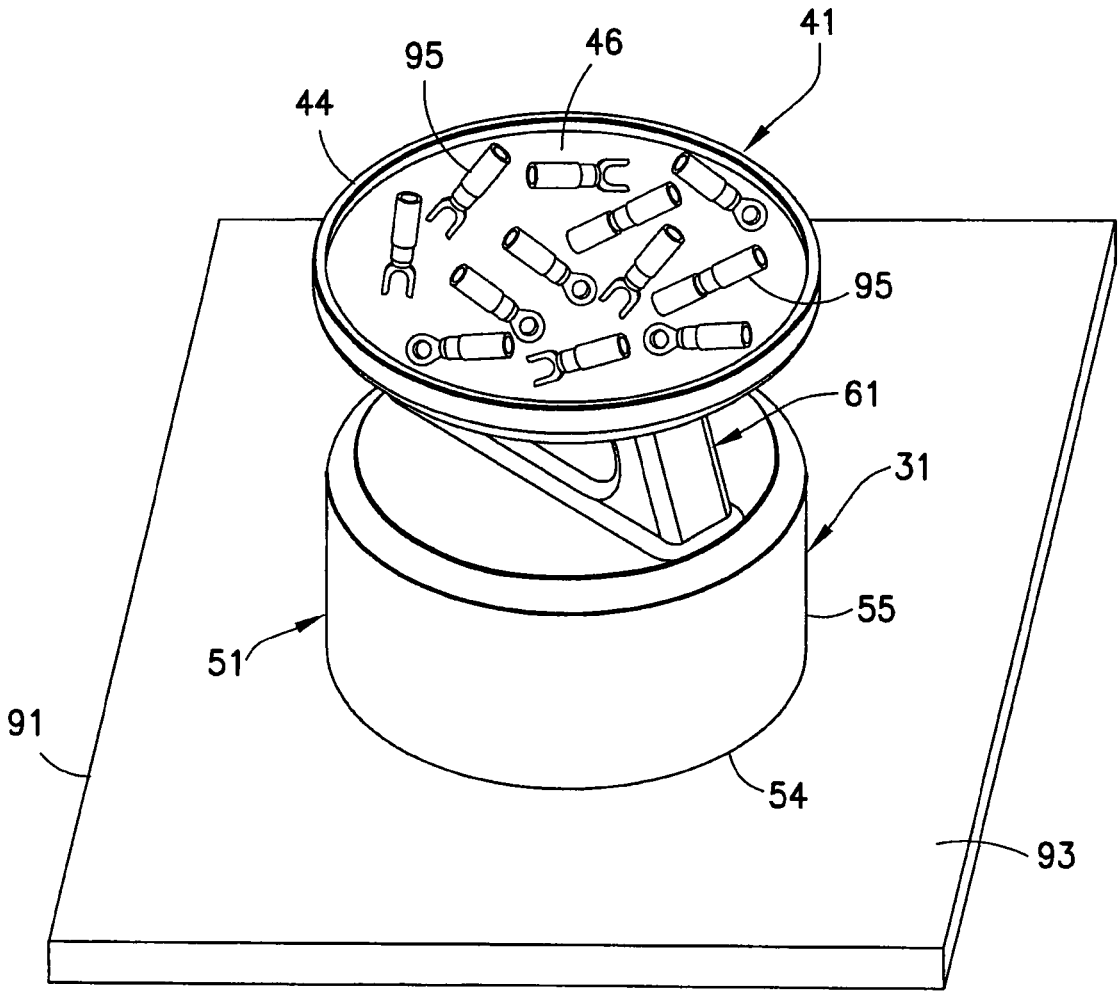
FIG. 18 is a perspective view of an upper portion of the cap receiving electrical components.

The jar 21 has a cavity 23 defined by a first base 25 and a first wall 27 extending upwardly from the first base, as shown in FIGS. 12-16. The base 25 of the jar 21 is preferably circular, as shown in FIG. 16. The first wall 27 has a reduced diameter portion 22, as shown in FIGS. 14 and 15, thereby forming a shoulder 24. An outer surface 28 of the first wall 27 has a first part 29 of a bayonet connection. An inner surface of the first base 25 is preferably substantially concave, as shown in FIGS. 1 and 18. Preferably, the first part 29 of the bayonet connection is formed on the outer surface 28 of the reduced diameter portion 22 of the jar 21. A tab or protrusion 26 is disposed in the first part 29 of the bayonet connection. A pair of protrusions 26 are preferably diametrically disposed, as shown in FIG. 15.

Figure 2:
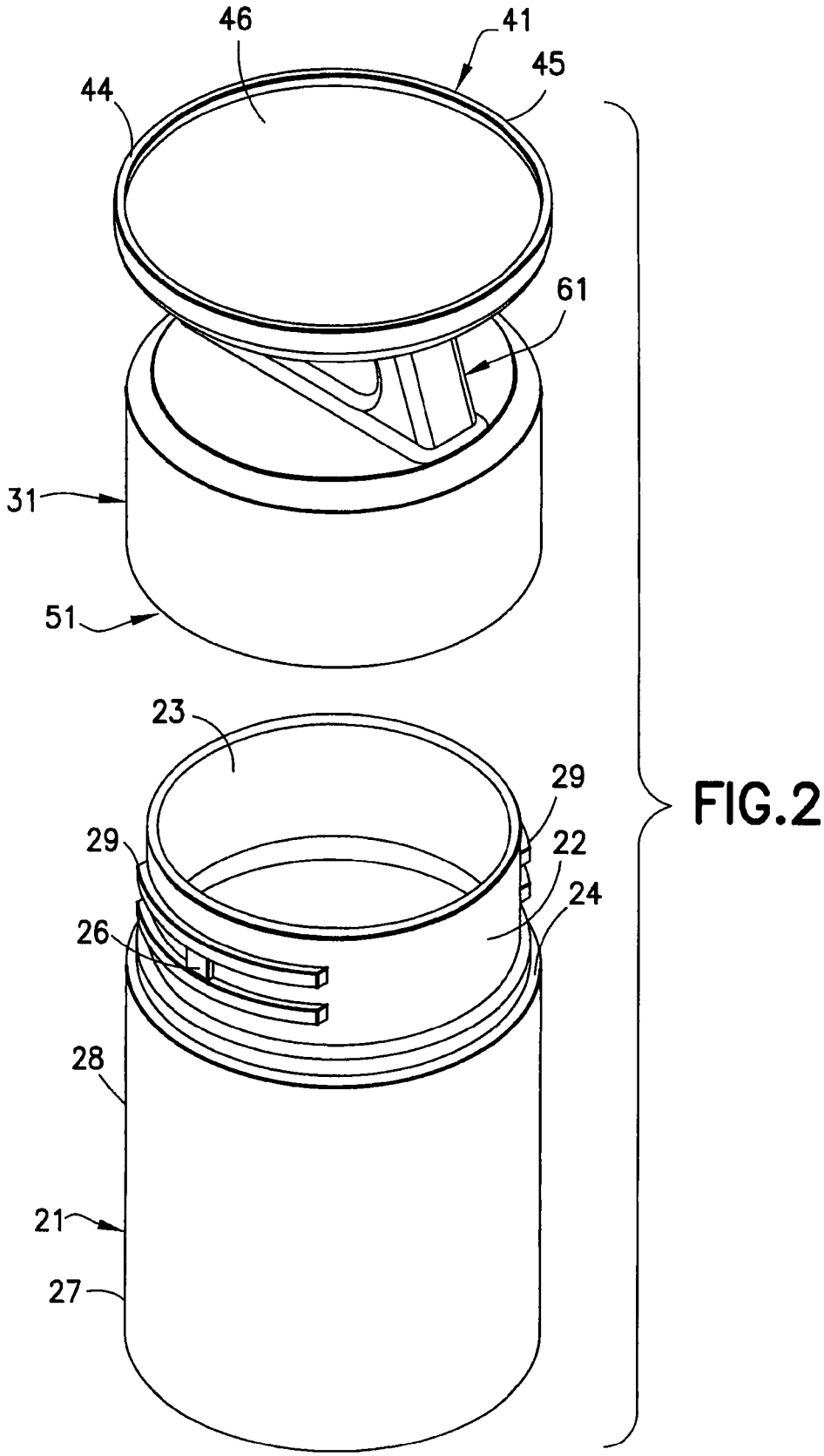
FIG. 2 is an exploded perspective view of the storage container of FIG. 1.
Figure 3:
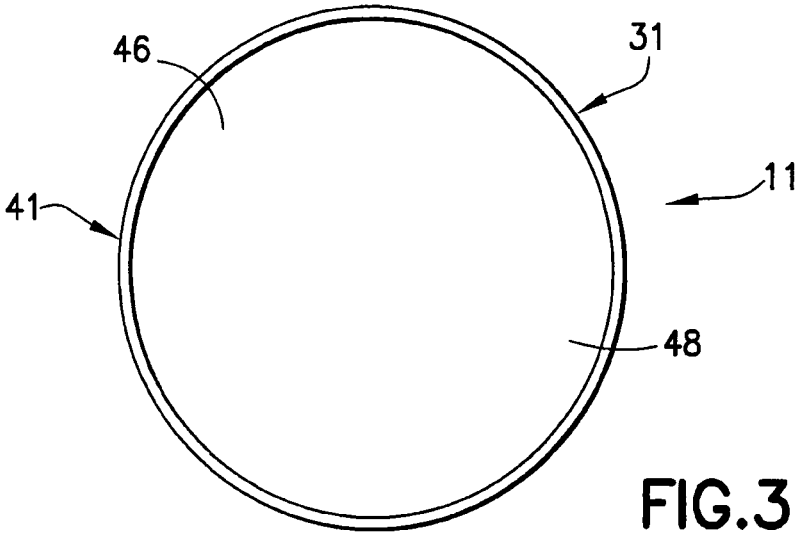
FIG. 3 is a top plan view of the storage container of FIG. 1.
Figure 19:
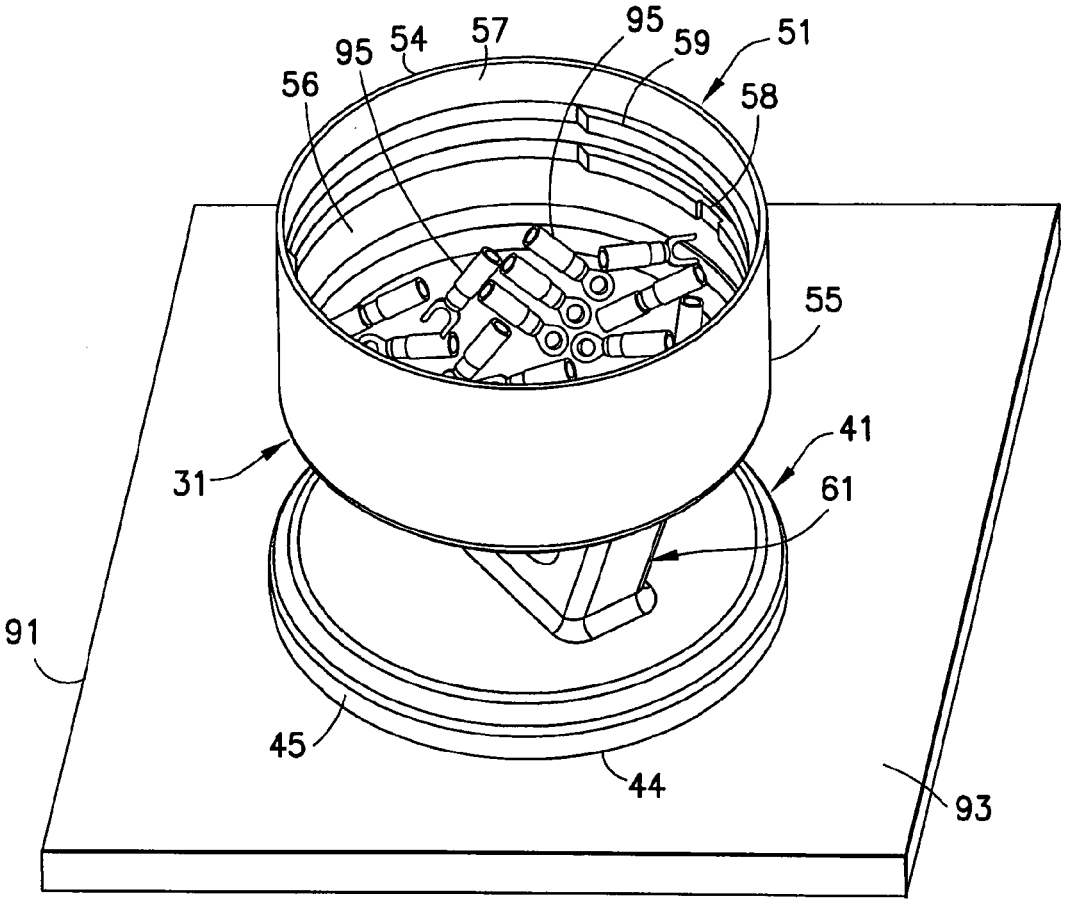
FIG. 19 is a perspective view of a lower portion of the cap receiving electrical components.

The cap 31 is removably connected to the jar 21, as shown in FIGS. 2, 18 and 19. The cap 31 has an upper portion 41 connected to a lower portion 51 by a connecting member 61, as shown in FIGS. 1, 2, 4 and 5.

Figure 7:
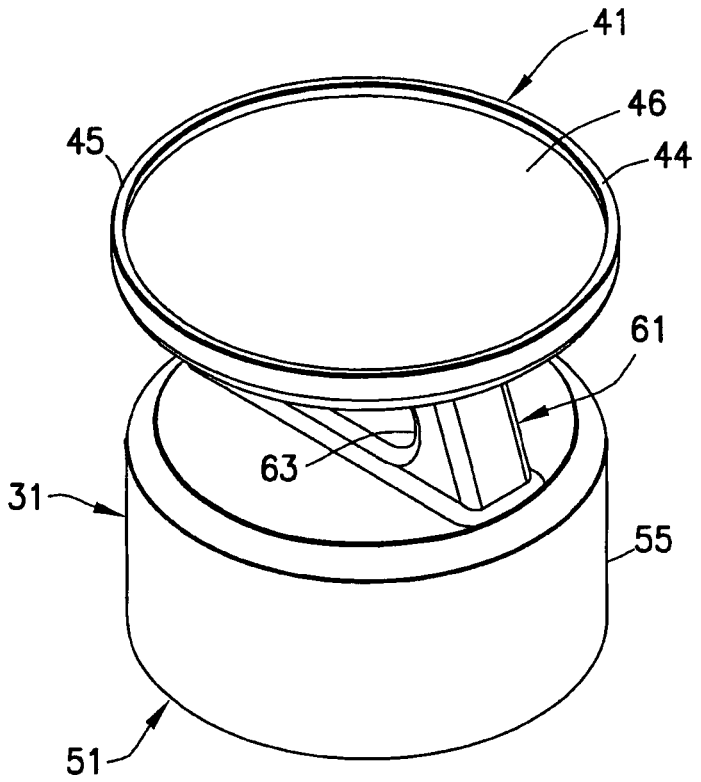
FIG. 7 is a perspective view of a cap of the storage container.
Figure 8:
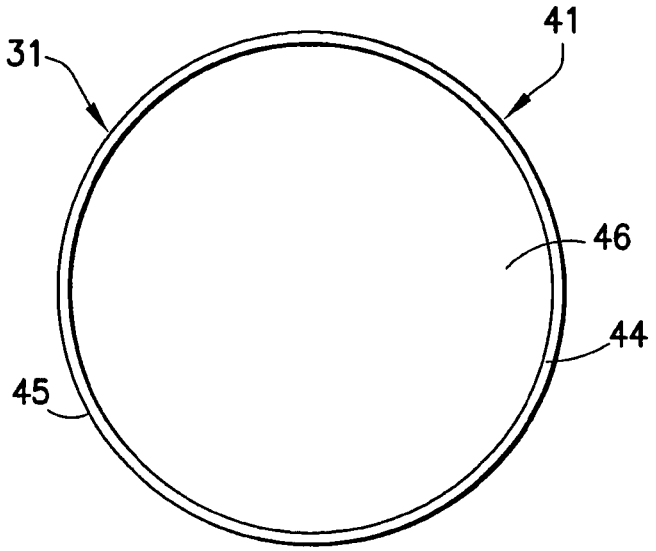
FIG. 8 is a top plan view of the cap of FIG. 7.
Figure 9:
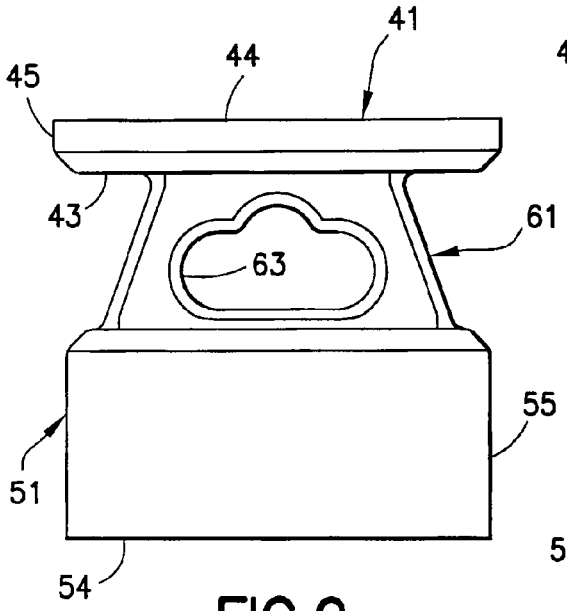
FIG. 9 is a side elevational view of the cap of FIG. 7.
Figure 10:
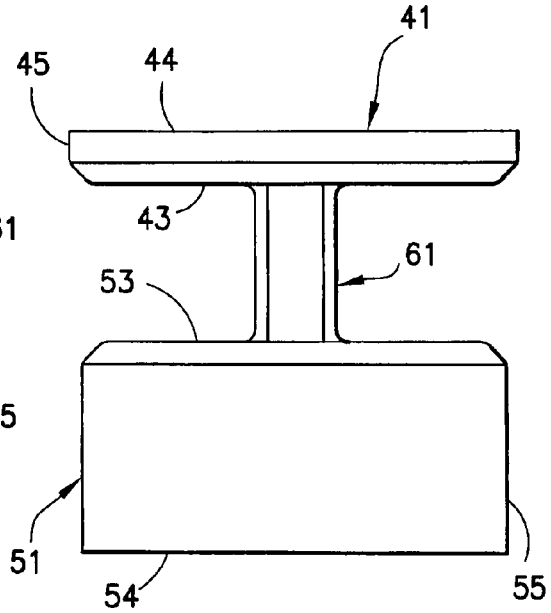
FIG. 10 is a front elevational view of the cap of FIG. 7.

The upper portion 41 of the cap 31 has a second base 43 and a second wall 45 extending upwardly from the second base to define a first receiving area 46, as shown in FIGS. 7 and 8. An inner surface 46 of the second base 43 is substantially planar, as shown in FIG. 1, to facilitate receiving electronic components stored in the cavity 23 of the jar 21. A free end 44 of the second wall 45 is substantially planar to facilitate positioning the cap 41 on the free end 44 of the second wall 45, as shown in FIGS. 9, 10 and 19.

Figure 4:
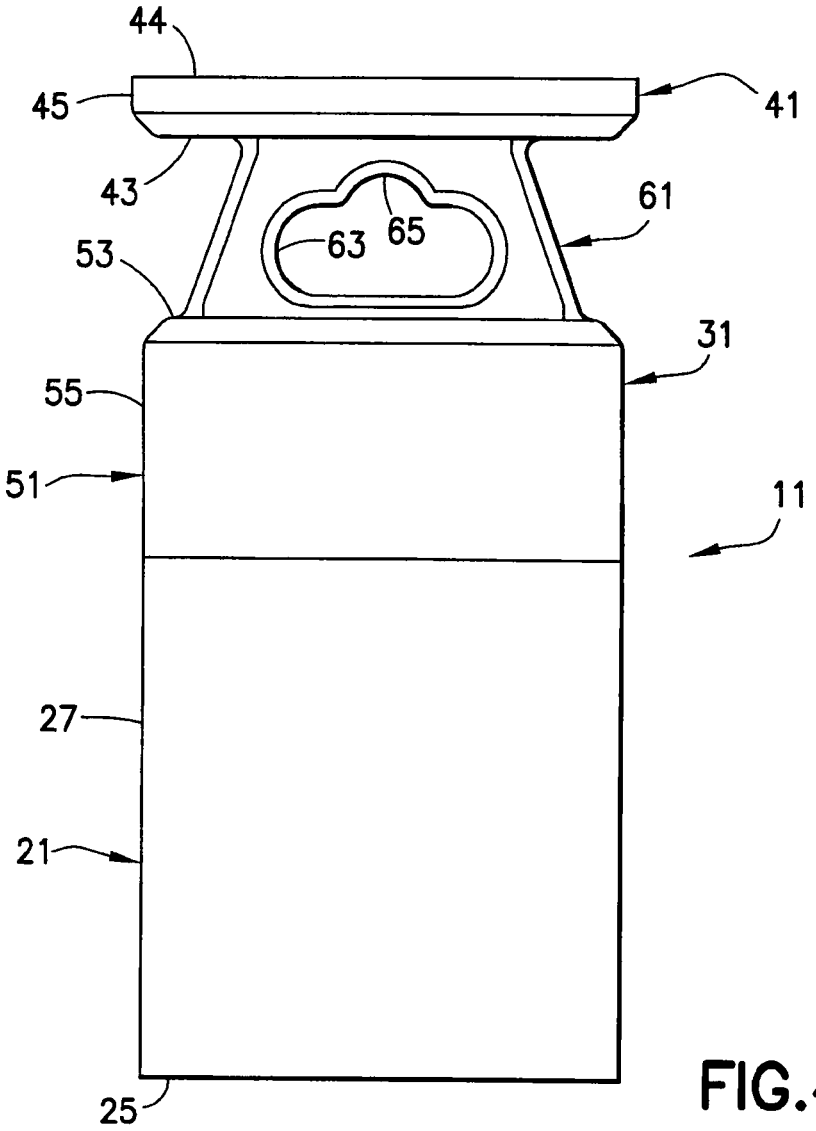
FIG. 4 is a side elevational view of the storage container of FIG. 11.
Figure 5:
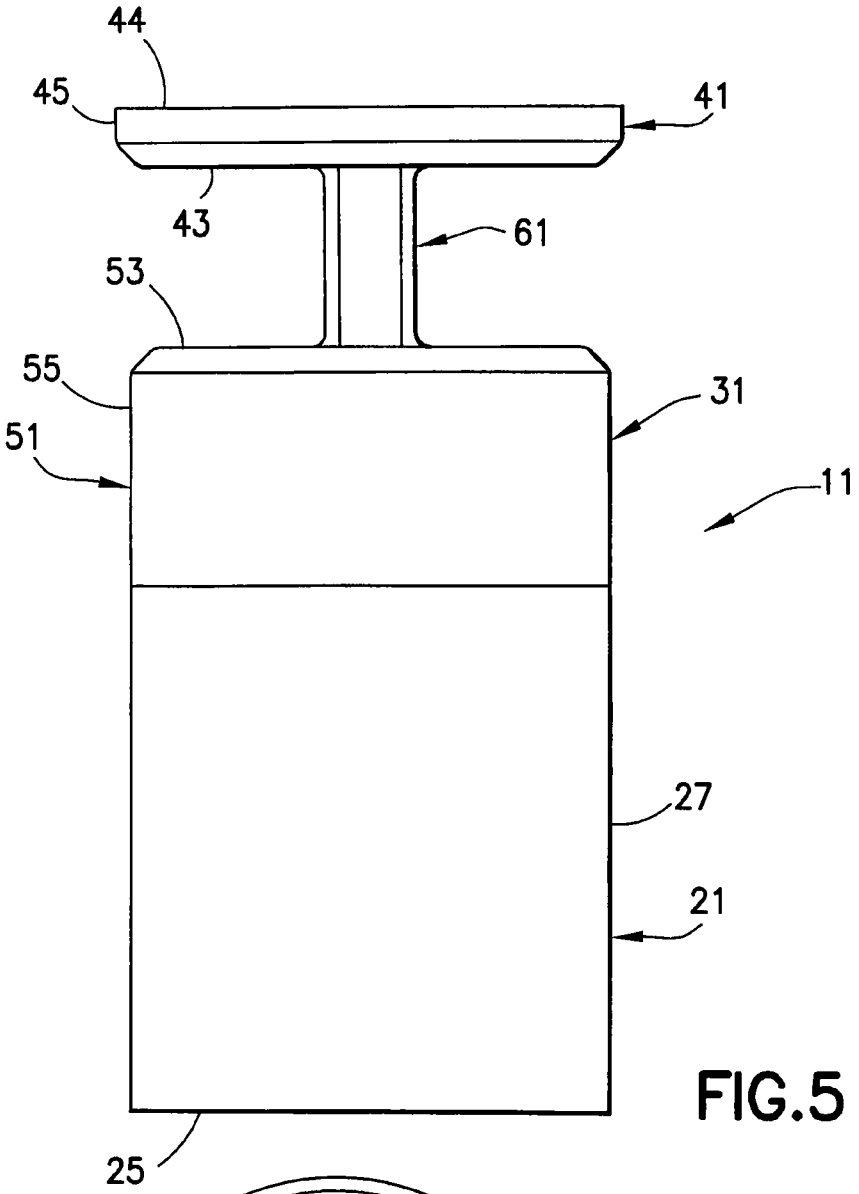
FIG. 5 is a front elevational view of the storage container of FIG. 1.
Figure 6:
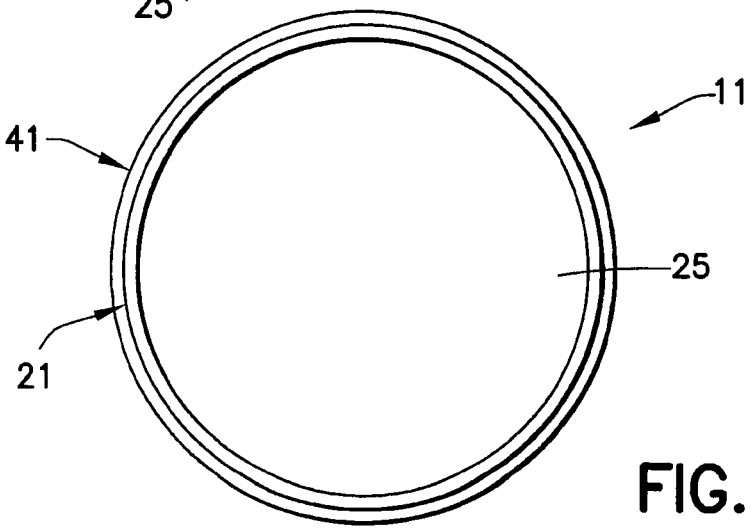
FIG. 6 is a bottom plan view of the storage container of FIG. 1.
Figure 11:
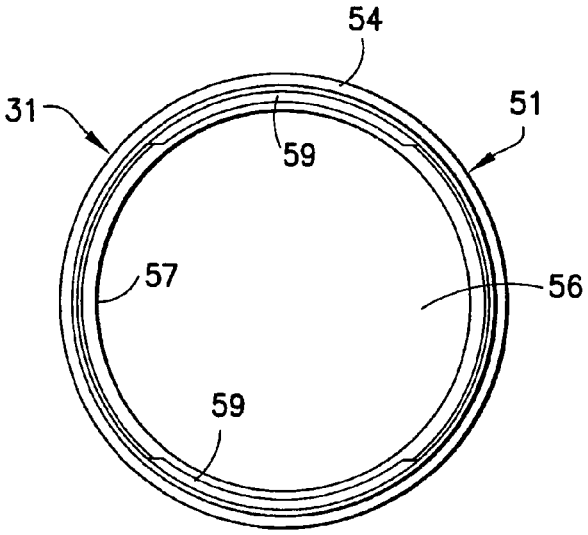
FIG. 11 is a bottom plan view of the cap of FIG. 7.
Figure 12:
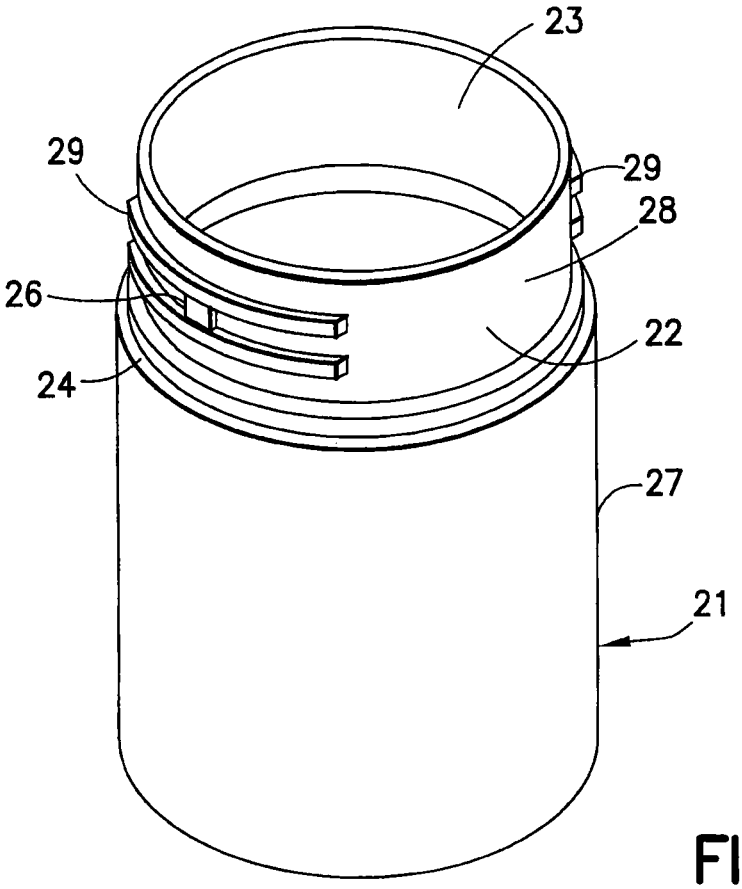
FIG. 12 is a perspective view of a jar of the storage container with the cap removed.
Figure 13:
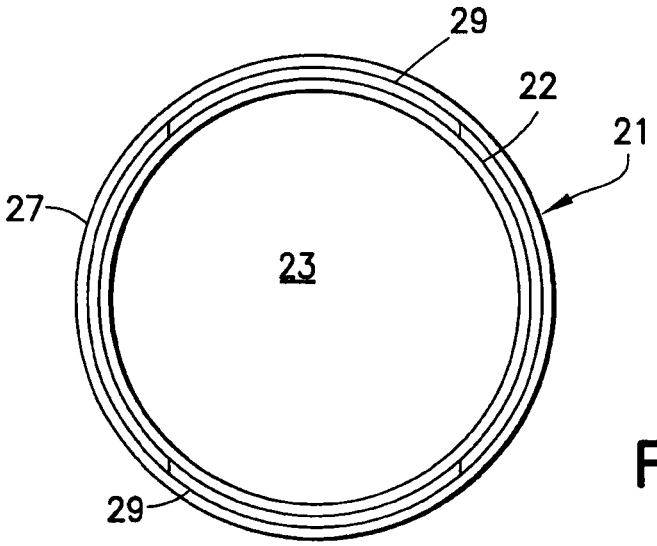
FIG. 13 is a top plan view of the jar of FIG. 12.

The lower portion 51 of the cap 31 has a third base 53 and a third wall 55 extending downwardly therefrom to define a second receiving area 56, as shown in FIGS. 11 and 19. The third wall 55 extends from the third base 53 in a direction substantially opposite to the direction in which the second wall 45 extends from the second base 43, as shown in FIGS. 4 and 5. A free end 54 of the third wall 55 is substantially planar to facilitate positioning the cap 51 on the free end 54 of the third wall 55, as shown in FIGS. 9, 10 and 18. An inner surface 57 of the lower portion 51 has a second part 59 of the bayonet connection, as shown in FIGS. 11 and 19. A detent or recess 58 is formed in the second part 59 of the bayonet connection, as shown in FIG. 19, to receive the protrusion 26 formed in the first part 29 of the bayonet connection of the jar 21 when connecting the cap to the jar. The cap 31 and/or jar 21 are resilient to facilitate engaging and disengaging of the protrusion 26 and the recess 58. The second receiving area 56 preferably has a larger volume than the first receiving area 48, as shown in FIGS. 9, 10, 18 and 19.

Figure 17:
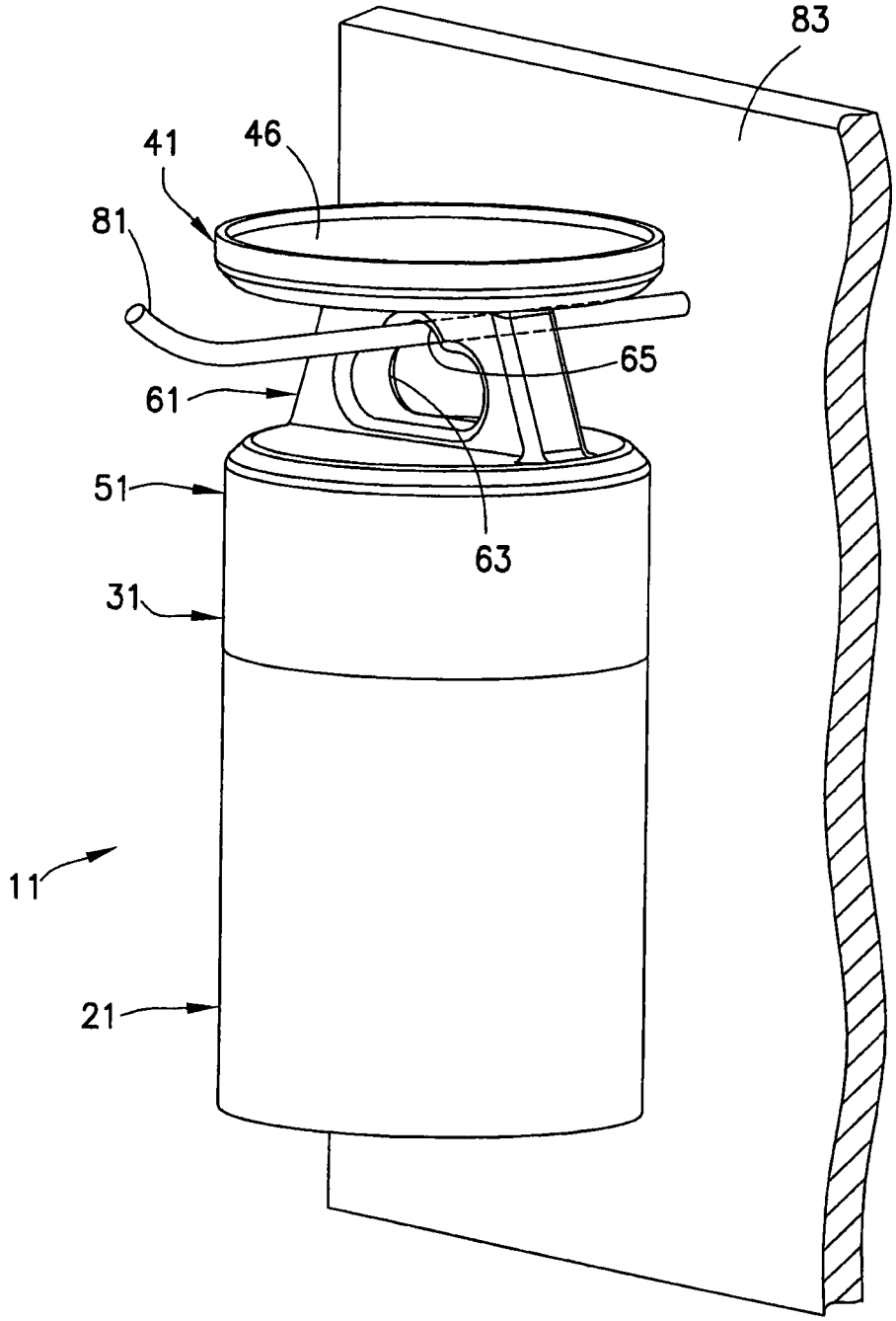
FIG. 17 is a perspective view of the storage container receiving or mounted on a support.

The connecting member 61 extends between the second base 43 of the upper portion 41 of the cap 31 and the third base 53 of the lower portion 51, as shown in FIGS. 1, 2, 4, 5, 9 and 10. An opening 63 extends through the connecting member, as shown in FIG. 4. The opening 63 has a substantially elliptical shape with a recess 65 formed in an upper portion of the opening to facilitate receiving a hook 81, as shown in FIGS. 4 and 17. The opening 63 preferably extends through the connecting member 61 in a direction substantially perpendicular to a longitudinal axis of the storage container 11.

Figure 20:
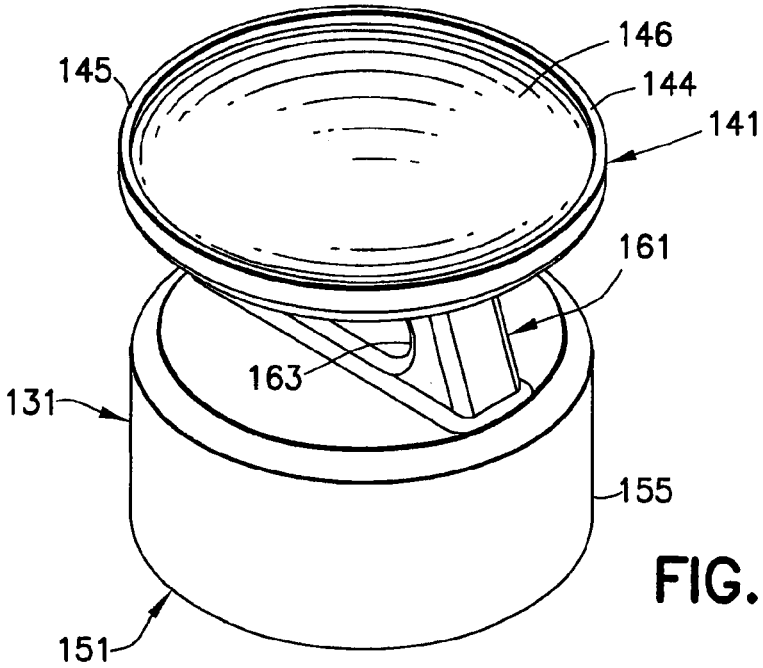
FIG. 20 is a perspective view of a cap in accordance with another exemplary embodiment in which an upper portion has a concave inner surface.

In an alternative embodiment shown in FIG. 20, the cap 131 has a first receiving area having a concave inner surface 146 to facilitate receiving electrical components. The remaining features of the cap 131 are substantially similar to the cap of FIG. 7 and use the same reference numeral in the 100 series.

The jar 21 and cap 31 of the storage container 11 are preferably made of polypropylene, although any suitable material may be used. The cap 31 and the jar 21 are each preferably unitarily formed or molded as one-piece members.

Assembly and Operation

The storage container 11 is shown completely assembled in FIGS. 1, 3-6 and 17, and disassembled in FIG. 2. The cap 31 is preferably connected to the jar 21 using a bayonet connection, but may be connected thereto in any suitable manner, such as with a threaded connection.

An outer surface 28 of the first wall has the second part 29 of the bayonet connection that receives the corresponding first part 59 of the bayonet connection of the lower portion 51 of the cap 31, as shown in FIGS. 11 and 19. To close the storage container 11, the cap 31 is positioned with respect to the jar 21 such that the free end 54 of the lower portion 51 abuts the shoulder 24 of the jar, as shown in FIG. 1. The cap 31 is then rotated approximately a quarter turn such that the first and second bayonet parts 59 and 29 guide the protrusions 26 into the corresponding recesses 58. Preferably, the upper portion 41 of the cap 31 does not have a corresponding bayonet part. The protrusions 26 engage the corresponding recesses 58 to secure the cap 31 to the jar 21. Electrical components, such as the electrical connectors 95 shown in FIGS. 18 and 19, can be stored in the storage container 11. To access the electrical connectors 95 stored in the cavity 23 of the jar 21, the cap 31 is rotated to disengage the protrusions 26 from the recesses 58. After rotating the cap approximately a quarter turn in either direction, the first and second bayonet parts are disengaged such that the cap 31 can be removed from the jar 21.

The storage container 11 can be stored by hanging the storage container on a hook 81 connected to a support, such as a wall 83, as shown in FIG. 17. The hook 81 is received by the recessed portion 65 of the opening 63 to facilitate hanging the storage container 11 on the hook 81 in addition to substantially preventing movement of the connecting member 61 along the hook.

After removing the cap 31 from the jar 21, the electrician can remove a few of the electrical connectors 95 from the jar cavity 23 and temporarily store them in the first receiving area 48 of the upper portion 41 of the cap 31 as shown in FIG. 18 or in the second receiving area 56 of the lower portion 51 of the cap 31 as shown in FIG. 19.

The free end 54 of the third wall 55 of the lower portion 51 of the cap 31 is substantially planar so that the lower portion of the cap can positioned on a substantially planar surface 93 of a support 91, such as a table or floor, as shown in FIG. 18. The first receiving area 48 is easily accessible by the electrician so that there is no need for the electrician to hold the needed electrical connectors in his hand or mouth.

Alternatively, the cap 31 can be positioned such that the second receiving area 56 is readily accessible, as shown in FIG. 19. The free end 44 of the second wall 45 of the upper portion 41 of the cap 31 is substantially planar so that the upper portion of the cap can positioned on the substantially planar surface 93 of the support 91, such as a table or floor, as shown in FIG. 19. The second receiving area 56 is easily accessible by the electrician so that there is no need for the electrician to hold the needed electrical connectors in his hand or mouth.

When the electrician's work has been completed, the unused electrical connectors 95 can be returned to the jar cavity 23. The cap 31 is then connected to the jar 21 to close the storage container 11, which can be hung on a hook 81 as shown in FIG. 17 for storage.

A storage container 111 in accordance with another exemplary embodiment is shown in FIGS. 21-33. The storage container 111 is substantially similar to the storage container 11 of the exemplary embodiment shown in FIGS. 1-19. Accordingly, similar features will not be described with regard to the exemplary embodiment of FIGS. 21-33 and are referred to with a reference numeral in the "1xx" series.

Figure 21:
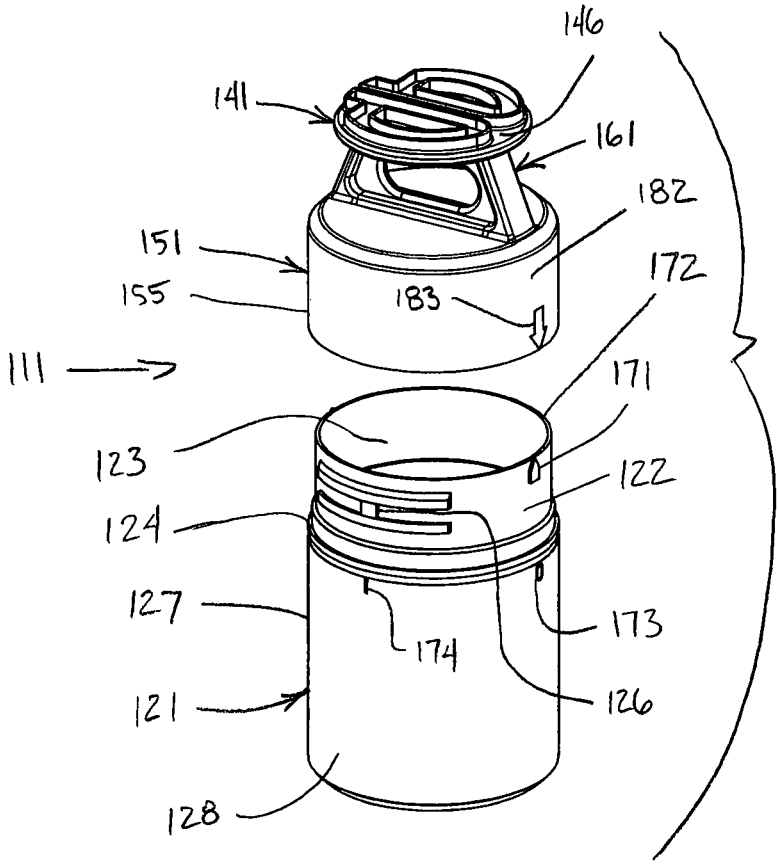
FIG. 21 is an exploded perspective view of a storage container in accordance with another exemplary embodiment of the present invention.
Figure 22:
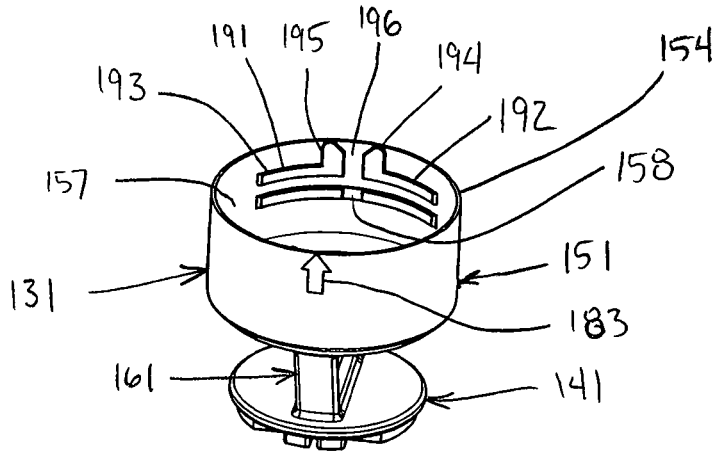
FIG. 22 is perspective view of a bottom of a cap of the storage container of FIG. 21.
Figure 23:
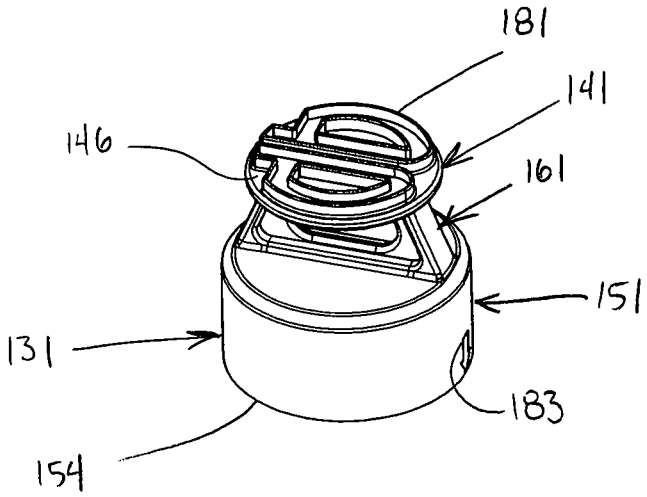
FIG. 23 is a perspective view of a top of the cap of the storage container of FIG. 21.

The jar 121 has a cavity 123 defined by a base 125 and a wall 127 extending upwardly from the first base, as shown in FIGS. 21 and 29-33. The base 125 of the jar 121 is preferably circular, as shown in FIGS. 29 and 33. The wall 127 has a reduced diameter portion 122, as shown in FIGS. 21 and 30-32, thereby forming a shoulder 124. An alignment indicator 171 is disposed on an outer surface 128 of the wall 127 of the jar 121, and is preferably disposed on the reduced diameter portion 122 adjacent a free end 172 of the wall 127. As shown in FIGS. 21 and 30, the alignment indicator 171 is an outwardly extending tab having a substantially pentagonal shape. Preferably, a pair of alignment indicators 171 are diametrically opposed on the outer surface 128 of the reduced diameter portion 122 of the wall 127, as shown in FIG. 31. A textured band 180 can extend circumferentially around the outer surface 128 of the wall 127 of the jar 121 to facilitate aligning a label affixed to the outer surface 128 of the jar 121. The jar 121 is preferably made of polypropylene and is transparent.

First and second cap position indicators 173 and 174 are disposed on the outer surface 128 of the wall 127, as shown in FIGS. 21, 30 and 31, to indicate whether the container 111 is in an unlocked or locked position. Preferably, the first cap position indicator or unlocked indicator 173 is vertically aligned with the alignment indicator 171, as shown in FIGS. 21 and 30. A substantially circular indicator 173, such as a "O", indicates the container 111 is in an unlocked position. A substantially vertical indicator 174, such as a I", indicates the container 111 is in a locked position. Preferably, the second cap position indicator or locked indicator 174 is vertically aligned with the protrusion or detent 126. Preferably, a pair of unlocked indicators 173 and a pair of locked indicators 174 are diametrically opposed, respectively, on the outer surface 128 of the jar 121. Accordingly, the indicators 173 and 174 alternate around the circumference of the jar 121 at approximately 90 degree intervals.

The base 125, as shown in FIG. 33, has a recessed portion 175. The recessed portion 175 of the base 125 can include descriptors, such as a recycling symbol 176, a time and date stamp 177 and a mold cavity number 178.

The cap 131 is removably connectable to the jar 121, as shown in FIG. 21. The cap 131 has an upper portion 141 connected to a lower portion 151 by a connecting member 161, as shown in FIGS. 21-23 and 25-27. Preferably, the cap 131 is made of polypropylene and is transparent. Additionally, the cap 131 can be colored, such as red, yellow, blue or gray.

A stacking member 181 extends upwardly from an inner surface 146 of a base 143 of the upper portion 141, as shown in FIGS. 21 and 23-27, to facilitate stacking assembled containers. The stacking member 181 can have any suitable shape, such as a company logo. Accordingly, a width 184 (FIG. 25) of the stacking member 181 substantially corresponds to a width 179 (FIG. 32) of the recessed portion 175 of the base 125 of the jar 121 such that a frictional fit secures the cap 131 of a first container 111 in the recessed portion 175 of the base 125 of the jar 121 of a second container 111. Additionally, the cap 131 can be connected to the base 125 of the jar 121 when accessing contents stored in the container 111 such that the cap 131 is not lost when disconnected from jar 121.

An outer surface 182 of a wall 155 of the lower portion 151 has an alignment indicator 183. Preferably, a pair of alignment indicators 183 are diametrically opposed on the outer surface 182 of the wall 155 of the lower portion 151.

Figures 24, 25, 26, 27, 28:
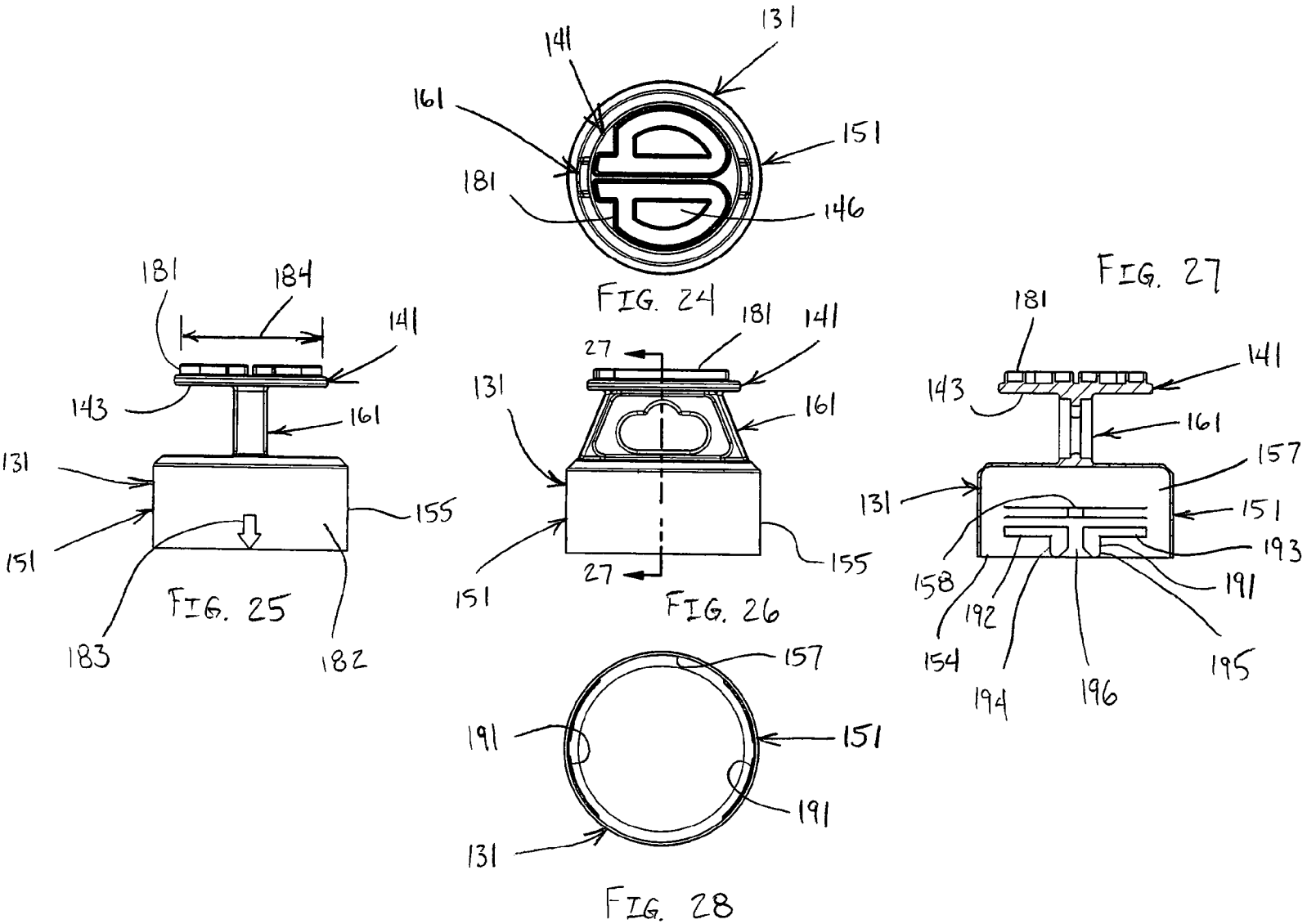
FIG. 24 is a top plan view of the cap of FIG. 21.
FIG. 25 is a front elevational view of the cap of FIG. 21.
FIG. 26 is a side elevational view of the cap of FIG. 21.
FIG. 27 is a front elevational view in cross-section taken along line 27-27 of FIG. 26.
FIG. 28 is a bottom plan view of the cap of FIG. 21.

An inner surface 157 of the lower portion 151 has a corresponding detent or recess 158, as shown in FIG. 27, to receive the corresponding detent or recess 126 of the jar 121 when connecting the cap 131 to the jar 121. An alignment guide 191 is formed on the inner surface 157 of the lower portion 151 of the cap 131, as shown in FIGS. 27 and 28. Preferably, a pair of alignment guides 191 are diametrically opposed on the inner surface 157, as shown in FIG. 28. The alignment guide 191 includes first and circumferentially extending ribs 192 and 193. Axially extending ribs 194 and 195 extend axially from the circumferentially extending ribs 192 and 193 toward a free end 154 of the wall 155 of the lower portion 151. An opening 196 is formed between the axially extending ribs 192 and 193 to receive the alignment indicator 171 of the jar 121. The free ends of the axially extending ribs 192 and 193 are preferably tapered inwardly, as shown in FIG. 27, to facilitate receiving the alignment indicator 171. The opening 196 is aligned with the cap alignment indicator 183

To connect the cap 131 to the jar 121, the cap 131 is positioned with respect to the jar 121 such that the alignment indicator 183 of the cap 131 is aligned with the alignment indicator 171 of the jar 121. Aligning the indicators 183 and 171 facilitate orienting the cap 131 with respect to the jar 121 during installation. The alignment indicator 171 of the jar 121 is received in the opening 196 in the alignment guide 191 of the cap 131, thereby substantially preventing misalignment of the cap 131 with respect to the jar 121 during installation. Additionally, the cap 131 is prevented from being connected to the jar 121 when the alignment indicators 171 and 183 are not aligned because the alignment indicator 171 abuts one of the circumferentially extending ribs 192 or 193 to prevent the cap 131 from being pushed onto the jar 121.

The cap 131 is pushed onto the jar 121 until the free end 154 of the lower portion 151 abuts the shoulder 124 of the jar 121, as shown in FIG. 1. The alignment indicator 183 of the cap 131 points toward the unlocked indicator 173 of the container 121, thereby indicating that the cap 131 is in the unlocked position. The cap 131 is then rotated approximately a quarter turn, as in the exemplary embodiment of FIGS. 1-19, such that the detent or recess 126 of the jar 121 is received by the corresponding recess or detent 158 of the cap 131, thereby securing the cap 131 to the jar 121. The alignment indicator 183 of the cap 131 now points toward the locked indicator 174 of the jar 121, thereby indicating that the cap 131 is in the locked position.

The installation procedure is reversed to remove the cap 131 from the jar 121. The cap is rotated approximately a quarter turn such that the alignment indicator 183 of the cap 131 is aligned with the first cap position indicator 173, thereby indicating that the cap 131 is not locked to the jar 121 and can be removed.

While advantageous embodiments have been chosen to illustrate the invention, it will be understood by those skilled in the art that various changes and modifications may be made therein without departing from the scope of the invention as defined in the appended claims.

What is claimed is:

1. A storage container, comprising:

a jar having a cavity defined by a jar base and a first wall extending upwardly from said jar base, a protrusion extending outwardly from an outer surface of said first wall;

a first alignment indicator being disposed on an outer surface of said first wall;

a cap removably connectable to said jar, said cap having an upper portion connected to a lower portion by a connecting member, said lower portion having a cap base and a cap wall extending downwardly therefrom, a recess on an inner surface of said cap wall for receiving said protrusion; and a second alignment indicator being disposed on an outer surface of said cap wall, said first and second alignment indicators being aligned when connecting said cap to said jar to substantially prevent misalignment of said cap with respect to said jar.

2. The storage container of claim 1, wherein a pair of said first alignment indicators are diametrically opposed on said outer surface of said jar.

3. The storage container of claim 1, wherein a pair of said second alignment indicators are diametrically opposed on said outer surface of said lower portion of said cap.

4. The storage container of claim 1, wherein first and second cap position indicators are disposed on said outer surface of said jar.

5. The storage container of claim 4, wherein said second alignment indicator is aligned with said first cap position indicator when said cap is not locked to said jar.

6. The storage container of claim 5, wherein said second alignment indicator is aligned with said second cap position indicator when said cap is locked to said jar when said recess receives said protrusion.

7. The storage container of claim 1, wherein a recessed portion is formed in said jar base.

8. The storage container of claim 7, wherein a stacking member extends upwardly from said upper portion of said cap.

9. The storage container of claim 8, wherein said stacking member is receivable by said recessed portion to secure said cap to said jar base.

10. The storage container of claim 8, wherein a stacking member of another storage container is receivable by said recessed portion of said storage container to stack said storage containers.

11. The storage container of claim 1, wherein said second alignment indicator includes an outwardly extending tab.

12. The storage container of claim 11, wherein an alignment guide is disposed on an inner surface of said cap wall to receive said second alignment indicator.

13. The storage container of claim 12, wherein said alignment guide includes an opening formed between first and second axially extending ribs to facilitate receiving said second alignment indicator.

14. The storage container of claim 13, wherein said axially extending ribs have inwardly tapered ends to guide said second alignment indicator into said opening.

15. The storage container of claim 13, wherein first and second circumferentially extending ribs extend from said first and second axially extending ribs to prevent said cap from being secured to said jar when said first and second alignment indicators are not aligned.

16. The storage container of claim 4, wherein said first alignment indicator is aligned with said first cap position indicator.

17. The storage container of claim 4, wherein said second cap position indicator is approximately 90 degrees from said first cap position indicator.

18. The storage container of claim 13, wherein said second alignment indicator is aligned with said opening in said alignment guide.

19. The storage container of claim 12, wherein a pair of said alignment guides are diametrically opposed on said inner surface of said cap wall.

* * * * *